United States Patent [19]

Kah, Jr.

[11] Patent Number: 4,867,378

[45] Date of Patent: Sep. 19, 1989

[54] SPRINKLER DEVICE

[76] Inventor: Carl L. C. Kah, Jr., 778 Lakeside Dr., North Palm Beach, Fla. 33408

[21] Appl. No.: 37,704

[22] Filed: Apr. 13, 1987

[51] Int. Cl.[4] ..... B05B 3/04

[52] U.S. Cl. ..... 239/206; 239/232; 239/DIG. 1; 239/587

[58] Field of Search ..... 239/203–206, 239/201, 202, 230, 236, 242, DIG. 1, 587, 596, 601, 465, 513

[56] References Cited

U.S. PATENT DOCUMENTS

| | | | |
|---|---|---|---|
| 3,526,363 | 9/1970 | Hauser | 239/242 X |
| 3,575,347 | 4/1971 | Carlson | 239/97 |
| 3,960,327 | 6/1976 | Olson | 239/236 |
| 4,198,001 | 4/1980 | Rodriguez | 239/236 X |
| 4,212,426 | 7/1980 | Choi | 239/230 |
| 4,234,125 | 11/1980 | Lieding | 239/205 X |
| 4,422,675 | 12/1983 | Norris et al. | 285/93 X |
| 4,498,626 | 2/1985 | Pitchford | 239/587 X |
| 4,540,125 | 9/1985 | Gornoy et al. | 239/DIG. 1 X |
| 4,637,549 | 1/1987 | Schwartzman | 239/236 X |

FOREIGN PATENT DOCUMENTS

| | | | |
|---|---|---|---|
| 553014 | 6/1932 | Fed. Rep. of Germany | 239/513 |
| 2102699 | 2/1983 | United Kingdom | 239/513 |

*Primary Examiner*—Andres Kashnikow
*Assistant Examiner*—Kevin P. Weldon
*Attorney, Agent, or Firm*—Jack N. McCarthy

[57] ABSTRACT

A sprinkler having a nozzle for directing a desired flow of water therefrom, the sprinkler having a water turbine drive device for rotating the nozzle in response to water passing through the sprinkler; the sprinkler has a seal between its cover and housing and with a pop-up riser, the nozzle being mounted in a rotatable nozzle housing connected to the water turbine drive device; a deflector is mounted in the nozzle housing for moving into and out of the water flow from the nozzle, the deflector being connected to a pivotally mounted arm with a cam follower actuated by a cam on the top of the riser; a modified sprinkler has two flow passages therethrough to a primary nozzle and secondary nozzle, the flow to the primary nozzle being directed through the water turbine drive device while the flow to the secondary nozzle is through a valving device to produce a predetermined contour.

7 Claims, 17 Drawing Sheets

SPRINKLER DEVICE

TECHNICAL FIELD

This invention relates to sprinklers where water pressure causes the sprinkler to rotate in order to provide water precipitation over a desired area

BACKGROUND ART

Rotatable sprinklers have been known in the prior art for use in irrigation. Patents setting forth a background for this invention are: U. S. Pat. Nos. 3,107,056; 3,713,584; 3,724,757; 3,854,664: 4,272,024; 4,353,507: and 4,568,024.

DISCLOSURE OF INVENTION

An object of this invention is to provide a sprinkler riser assembly having a long, thin-walled, seal member which is flexible, permitting better tolerance to dirt particles and providing enhanced sealing with operating pressure.

Another object of the invention is to provide a double-walled seal connected at the top, forming a cylindrical seat for the retraction spring. The long inner wall of the seal surrounding the riser assembly has sealing contact rings therearound which are pressed against the riser assembly during pressurization of the sprinkler when the riser assembly is being forced up out of the sprinkler cylindrical housing In this construction, the sealing pressure between the seal and the riser assembly is increased by the pressure on the seal by the water pressure entering the sprinkler just when minimum leakage is desired; and this pressure is removed when only the spring retraction force is available to retract the riser assembly into the sprinkler cylindrical housing.

A further object of this invention is to provide nozzle sprinkler having a rotatable nozzle housing including a nozzle, with a deflector means within said housing for programmably moving in or out of the flow directed from said nozzle during operation.

Another object of the invention is to provide a riser member on which a nozzle housing including a nozzle is located, a deflector being pivotally mounted to said nozzle housing and having a cam follower for moving said deflector, said cam follower being moved into flow from the nozzle by a cam member formed on the top of said riser member.

Another object of the invention is to provide a rotating nozzle sprinkler having primary and secondary dual flow passages therethrough connected, respectively, to a primary nozzle and secondary nozzle, said secondary flow passage having a first fixed annular opening aligned with a rotating second annular opening directing water flow to the secondary nozzle; an annular secondary flow inlet insert having arcuate inlet ports is placed in s id first fixed annular opening and a secondary flow control plate having arcuate valving openings is placed over said rotating second annular opening. Sealing means are provided between said secondary flow inlet insert and flow control plate. The arcuate inlet ports and arcuate valving openings can be preselected to obtain a desired flow pattern from the secondary nozzle A further object of the invention is to provide a pop-up rotating nozzle sprinkler with two nozzle water passageways therethrough, one passageway bypasses a turbine drive system for the rotating nozzle sprackler to provide full water source pressure to at least one of the nozzles for maximum range, the second passageway passes through the turbine drive system to rotate the nozzle sprinkler and to provide water at a reduced pressure to the other of the nozzles for a shorter range Another object of the invention is to provide the outer housing of a nozzle sprinkler with a lug that allows lock wiring of the housing to a water supply pipe to prevent rotation thereof which (1) provides for easy turning of the riser member in said housing for directionally positioning the nozzle; (2) provides for easily removing or replacing the cover on the housing without the need of holding the housing; and (3) provides a deterrent to unauthorized removal including theft.

A further object of this invention is to provide rotatable nozzle housing having a cylindrical nozzle positioned in a cylindrical bore for rotation, said nozzle exit opening being located on a center line of said cylindrical nozzle while the outlet passageway of the nozzle has an axis which is at an angle to the axis of the cylindrical nozzle; rotation of said nozzle will angularly change the water stream leaving the nozzle to elevate or lower the stream to attain desired water pattern results. This movement maintains the same relationship of the nozzle exit opening with a fixed position of a deflector.

Another object of this invention is to provide a rotatable nozzle housing having a cylindrical nozzle positioned in a cylindrical bore, said nozzle having two flow passageways therethrough, a center conventional nozzle flow passage and a staggered nozzle flow passage where water flow is directed through large angle turns, said flow being blocked and forced to turn and impact on a surface and then turn and exit out the nozzle. This configuration provides turbulence for short range stream breakup and coverage even with larger passage sizes used to obtain insensitivity to dirt. This configuration is simple for easy manufacture, as a single molded part can be created by only straight pull cores A further object of this invention is to provide a sealing device for sealing a shaft extending between a first housing containing a pressurized lubricant and a second housing containing pressurized water; said first housing including a gear driving means while said second housing is fixed to said output shaft and has a nozzle therein Another object of the present invention is to provide a rotating nozzle sprinkler having a water driven gear box containing lubricant vented through the bottom of the gear box to water under pressure flowing past the gear box through the sprinkler; the vent has a cylindrical bore in the gear box extending downwardly while the lower gear box cover has an annular member extending upwardly and placed in said bore, the vent between the lubricant and water is an extended passage between the gear box cylindrical bore and gear box cover annular member, a passage extender, and a felt plug. The high point of the vent has an expanded volume to allow any lubricant getting into the high point area to float and coalesce on the more dense water.

Another object of the invention is to provide a cover and riser assembly removal and replacing tool for a water sprinkler, said tool having a handle to permit one to remove or replace the cover and riser assembly in a standing position. This is one advantage of having the housing of the sprinkler fixed against rotation, and having a quick connect-disconnect connection between the cover and housing.

A further object of the invention is to provide a cover and riser assembly removal and replacing tool for a water sprinkler having a cylindrical member with a recess to fit over the top of the cover and riser assembly with openings to receive equally spaced ear members on the cover, said tool having a lifting pin to engage an opening in each ear member as the tool is rotated to unlock the cover.

A further object of the invention is to provide a slip connection in the drive mechanism of the sprinkler to prevent damage by forced rotation of the sprinkler.

Another object of the invention is to provide a device which will allow the pop-up riser member to be turned within the housing of a sprinkler to properly set the nozzle with a ground reference.

A further object of the invention is to provide a cam locking cover that extends down into the cylindrical housing so that the cylindrical housing can be gripped if necessary to hold while the cover is removed or replaced. This is advantageous if the cylindrical housing is not lock wired against rotation.

Another object of the invention is to provide a sprinkler having a direct reading adjustable arc gear drive with an easily removable and replaceable cover and riser assembly having the sprinkler gear drive and a filter assembly therein, with said riser assembly being easily movable to a ground reference after replacement.

BEST MODE FOR CARRYING OUT THE INVENTION

Figure 3:
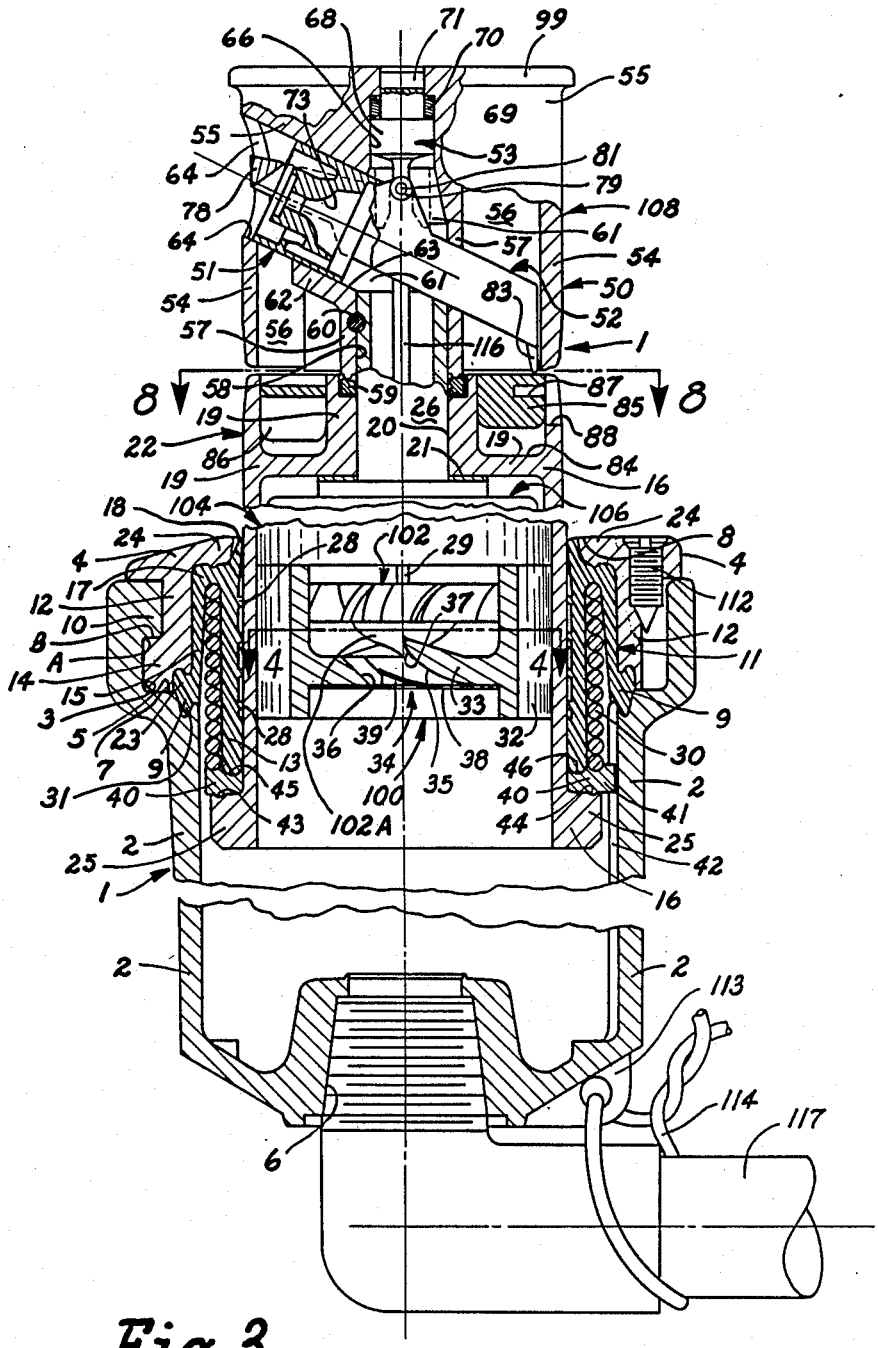
FIG. 3 is a fragmentary longitudinal sectional view of the sprinkler in its extended position taken on the line 3—3 of FIG. 2 with portions of the top of the nozzle housing shown in full; the cover and associated cylindrical housing are shown on the line 3A—3A of FIG. 2 to set forth the cooperation of the cover locking screw and top of the cylindrical housing; the turbine housing and inlet nozzle means is shown projecting out of the longitudinal section as shown by the line 2—2 of FIG. 4 and the adjustable cam member is set to cam the cam follower to vary the position of the deflector in the flow of water exiting from the nozzle.

Referring to FIG. 3 of the drawings, a pop-up sprinkler 1 is shown having a cylindrical housing 2 with a cover 4 on top thereof. An internally threaded inlet 6 is located at the center of the bottom thereof. Cover 4 is connected to the top of the cylindrical housing 2 and has an opening 8 at the center thereof for receiving an axially movable nozzle housing assembly 108 and riser member 16. and a fixed resilient cylindrical sealing member 11; said opening 8 leaving an annular flange portion 24 of cover 4 projecting inwardly over the cylindrical housing 2; said riser member 16 has an annular flange 25 at its bottom end projecting outwardly towards the wall of the cylindrical housing 2, in line with said annular portion 24. A riser member retraction spring 30 is located between said annular flange portion 24 and annular flange 25, in a manner to be hereinafter described In FIG. 3, the cover 4 is shown connected to the top of the cylindrical housing 2 by a quick connect-disconnect device which consists of three radial lugs 10 equally spaced around the upper part of an enlarged inner circumference 3 at the top of the cylindrical housing 2. This enlarged inner circumference 3 forms an upwardly facing annular surface 5 with the inner surface of the cylindrical housing 2. The cover 4 has a downwardly extending flange 12 with three outwardly extending lugs 14; each lug 14 is sized to pass between each pair of adjacent lugs 10. Downwardly facing surfaces A of the lugs 10 and upwardly facing surfaces B of the outwardly extending lugs 14 engage each other when the cover 4 is placed on the cylindrical housing 2 and rotated to attach the cover 4. The surfaces A and B are tapered so that during relative locking movement, the lower end surface 7 of the downwardly extending flange 12 of top cover 4 is moved towards the upwardly facing annular surface 5 of the cylindrical housing 2 to provide a sealing engagement with the flange seal portion 9 of resilient cylindrical sealing member 11 that is between the end surface 7 of the downwardly extending flange 12 of top cover 4 and the top of the upwardly facing annular surface 5 of cylindrical housing 2.

Figure 1:
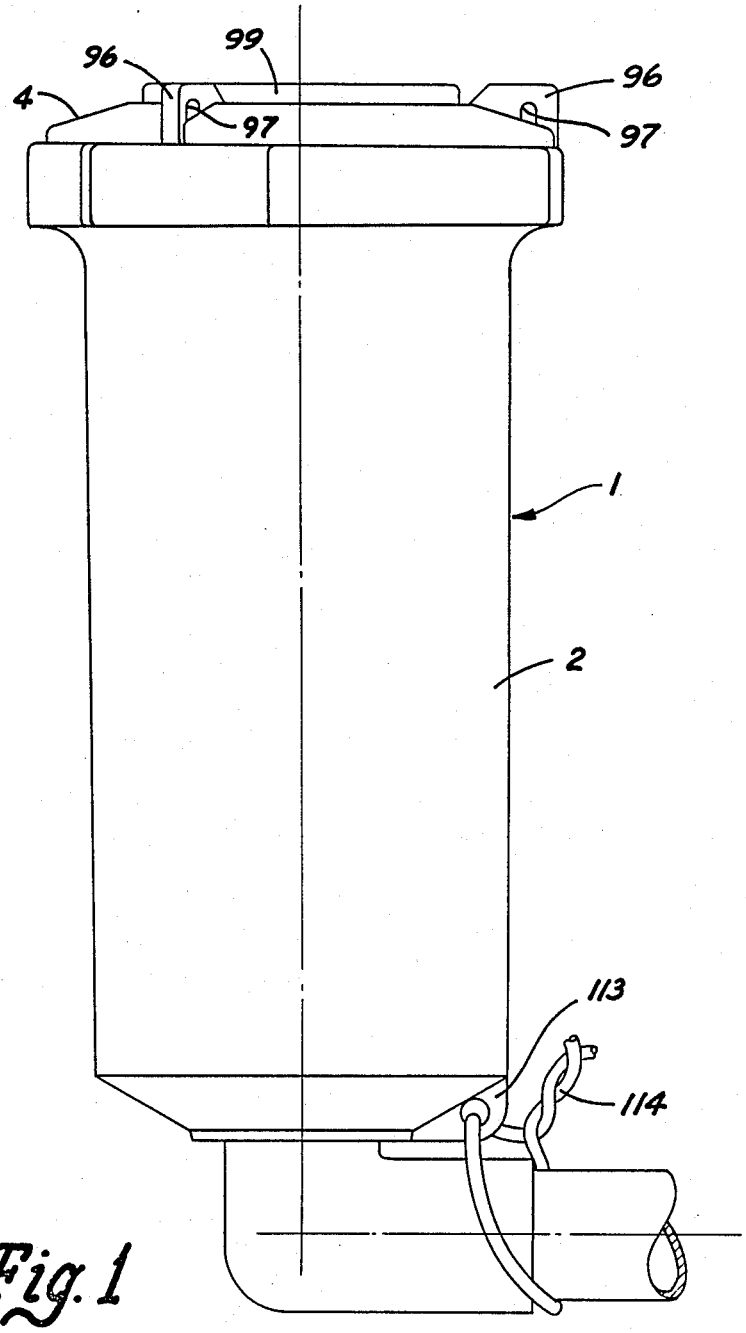
FIG. 1 is a side view of the sprinkler shown in its retracted position with the housing fixed against rotating to the water supply pipe.

The cylindrical housing 2 encloses a riser assembly 22 including the riser member 16 which provides the "pop-up" action of the sprinkler 1. The riser member 16 is slidably mounted with respect to the cylindrical housing 2 so that it moves between the down position shown in FIG. 1 and up position where the riser member 16 extends through the resilient sealing cylindrical member 11 around the opening 8 in the cover 4 as shown in FIG. 3.

To prevent unauthorized removal, including theft, of a cylindrical housing 2 from a ground location, a locking lug 113 having an opening is provided at the bottom thereof, so that the cylindrical housing 2 can be lock wired by a wire 114 to water pipe 117 leading to the opening 6. To prevent a similar removal of the sprinkler riser assembly 22, cover 4 and fixed resilient cylindrical sealing member 11, from the cylindrical housing 2, a threaded locking pin 112 is provided in the cover 4 for projecting down into the enlarged inner circumference 3 to block removal of the cover 4 by blocking the rotation of the cover 4 by contacting a lug 10.

Riser assembly 22 is comprised of five (5) main parts mounted in or on the riser member 16. These parts are:

(1) a turbine housing and inlet nozzle means 100;
(2) a water drive turbine wheel 102;
(3) a reduction gear drive 104;
(4) a reversing gear drive 106; and
(5) a sprinkler nozzle housing assembly 108 at the top.

The fixed resilient cylindrical sealing member 11 is formed of resilient sealing material, such as rubber, having a long inner cylindrical portion 13 and a shorter outer cylindrical portion 15 connected at the top by an annular portion 17; said long inner cylindrical portion 13 and outer shorter cylindrical portion 15 being spaced, and said annular portion 17 contoured to receive the upper end of retraction spring 30.

Outer shorter cylindrical portion 15 is located against the inner side of downwardly extending flange 12 of top cover 4 and has the flange seal portion 9 projecting outwardly from the bottom thereof for positioning between the end surface 7 of downwardly extending flange 12 and annular surface 5 of cylindrical housing 2. Flange seal portion 9 has an upwardly extending annular projection 23 which mates with a mating annular groove in surface 7 and a downwardly extending annular projection 31 which mates with a mating annular groove in surface 5 This downwardly extending annular projection 31 has tapered sides and is smaller at the bottom to aid in its fitting into the mating annular groove in surface 5 during assembly of the cover 4 to the housing 2.

Figure 2:
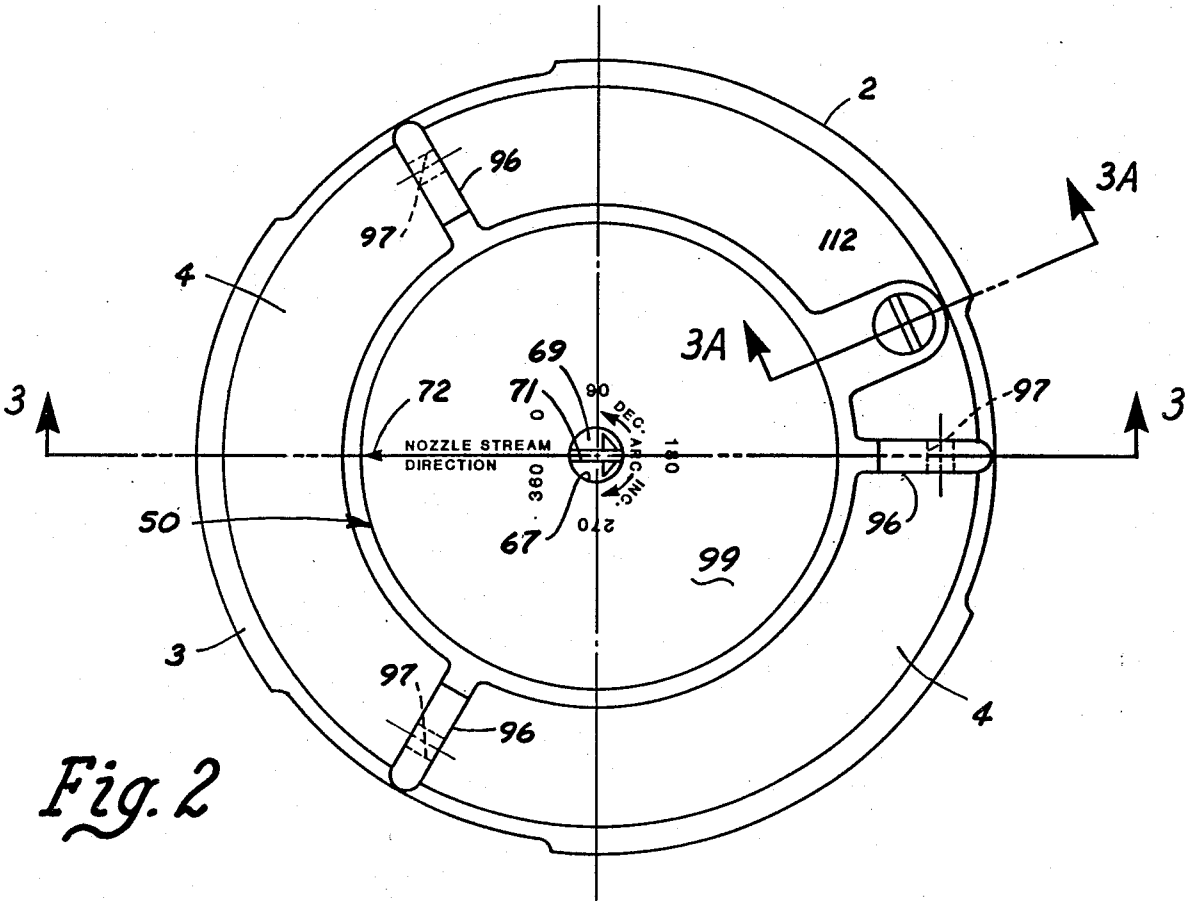
FIG. 2 is a top view of the sprinkler showing the cover and axially movable center nozzle housing assembly.

Long inner cylindrical portion 13 is located adjacent the outer side of the movable riser assembly 22 and has sealing contact rings 28 engaging the riser assembly 22. The upper surface of annular portion 17 engages the inner surface of annular portion 24, biased by retraction spring 30. A circular lip portion 18 also extends upwardly from the annular portion 17 into opening 8 in line with the long inner cylindrical portion 13 and tapers inwardly to touch the riser assembly 22. The opening 8 is spaced outwardly a small distance from the outer surface of circular lip portion 18 to permit small movements thereof The lower end of retraction spring 30 rests in a circular spring seat in spring retainer ring 40 which is placed against annular flange 25 of riser member 16. It can be seen that retraction spring 30 biases the riser assembly 22 to its retracted position and acts on fixed resilient cylindrical sealing member 11. Spring retainer ring 40 has a radial extending projection 41 which rides in a longitudinal slot 42 along the length of cylindrical housing 2. This prevents rotation between spring retainer ring 40 and cylindrical housing 2. Small projections 43 extend downwardly from the bottom surface of the spring retainer ring 40. Each projection 43 rests in a mating recess 44 in the top surface of annular flange 25. These projections 43 and recesses 44 tend to maintain the spring retainer ring 40 and annular flange 25 at a set relative position against rotation, and therefore riser assembly 22 and cylindrical housing 2. This construction permits one to rotate the riser assembly 22 relative to the cylindrical housing 2 by forcing the projections 43, in one direction or the other, over the recesses 44 to properly place the riser assembly for its angular coverage. When the riser assembly 22 is forced by water pressure to its full "up" position, as shown in FIG. 2, the length of the compressed retraction spring 30 and the length of the long inner cylindrical portion 13 of sealing member 11 are designed to have the bottom circular sealing edge 45 of the long inner cylindrical portion 13 mate and seal with a groove 46 located around the inner edge of the spring retainer ring 40. next to the spring seat for retraction spring 30.

Riser member 16 comprises a cylindrical member open at its lower end inwardly of annular flange 25 and formed with an inwardly extending annular flange 19 at its upper end having a center shaft opening 20. The reversing gear drive 106 is located in the upper cylindrical area of riser assembly 16 with a thrust washer 21 placed against the inner surface of the annular flange 19 and with its hollow cylindrical output shaft member 26 extending through the center shaft opening 20 to the exterior of the riser member 16 and into the sprinkler nozzle housing assembly 108.

The reduction gear drive 104 is located in the cylindrical member of riser assembly 16 with an output shaft 27 (see FIG. 16) connected to the reversing gear drive 106; the reduction gear drive 104 is positioned in the cylindrical member by a press fit, also positioning the reversing gear drive 106. Details of a reversing gear drive and its operation are shown in U.S. patent application Ser. No. 932,470, filed Nov. 18 1986 of Carl L. C. Kah, Jr. While a specific construction is referred to, other known reversing and reduction gear drive devices can be used. The subject matter of U.S. patent application Ser. No. 932,470 is included herein by reference as if it were fully set forth.

Turbine wheel 102 is located below said reduction gear drive 104 and is connected thereto by drive shaft 29. The turbine housing and inlet nozzle means 100 has a cylindrical housing 32 with an intermediate partition 33 which divides the cylindrical housing into two compartments, one enclosing the turbine wheel 102, while the other provides an inlet to nozzles 34 in the partition 33. The turbine housing and inlet nozzle opening means 100 has a press fit within the lower cylindrical area of riser member 16 and is located against the bottom of the reduction gear drive 104.

Figure 4:
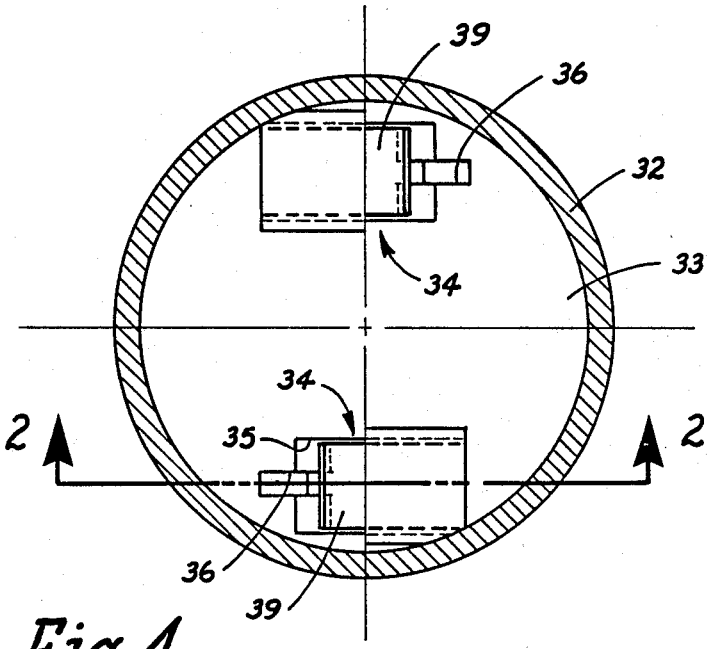
FIG. 4 is a sectional view of the turbine housing and inlet nozzle means taken on the line 4—4 of FIG. 3 showing the two nozzles and with the turbine wheel nose cone removed.

The partition 33 has two inlet nozzles 34 to direct water to the turbine wheel 102. Each nozzle is formed by an angled rectangular passageway 35 extending through the partition 33. In this construction, two nozzles 34 are shown (see FIG. 4) with the flow directed into the concave section of the blades of the turbine wheel 102. A nose cone 102A extends from the center of the turbine wheel 102 to said partition 33 between the two nozzles 34.

The forward part of the passageway 35 is formed as a flat ramp with a groove 36 extending from one end to the other through the partition 3 to provide a minimum flow area. The rearward part of the passageway has an extended rear surface 37 which extends into the compartment containing the turbine wheel 102. Said rear surface 37 is curved and has two sides to prevent the passageway 35 from directing a partial flow sideways.

Figure 5:
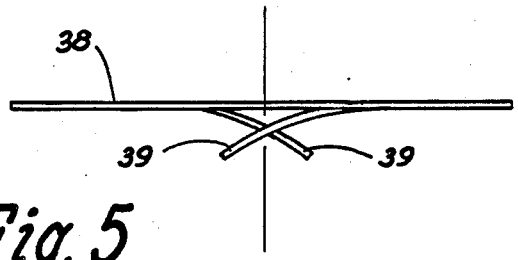
FIG. 5 is a side view of the nozzle plate with the spring fingers in their formed position.

A nozzle plate 38 is formed having two spring fingers 39 for controlling flow through the nozzles 34. The nozzle plate 38 is sized to fit in the inlet compartment of the cylindrical housing 32 against partition 33 and be fixed therein. Each spring finger 39 is pre-formed, by bending in the direction away from the direction of operative movement, as shown in FIG. 5, to provide a pre-load when the nozzle plate 38 is put in place with each spring finger 39 being placed in its passageway 35. Each spring finger 39 is pre-loaded when the spring fingers 39 are bent upwardly to be inserted in the nozzles 34 where they will rest on the flat ramp and extend over the grooves 36.

Bending the spring fingers 39 into operative position provides a pre-load on these spring fingers 39 so that they will not move further open until the pressure necessary to operate the turbine has been reached. Yet once the minimum turbine operating pressure has been reached (spring finger pre-load), they will open further with a minimum additional pressure drop. This provides for a more constant pressure differential across the turbine inlet, resulting in a more constant speed while allowing for use of different sizes of sprinkler nozzles 51.

The sprinkler nozzle housing assembly 108 is comprised of four (4) main parts. These parts are:

(1) a nozzle housing 50;

(2) a nozzle 51;

(3) a nozzle stream deflector device 52; and (4) an adjustable oscillating output control 53 for the reversing gear drive 106.

Nozzle housing 50 is formed as a cylindrical member 54 having an outer surface approximately the same diameter as that of riser member 16. The interior of the housing 50 is formed having a solid top and upper area 55 with a lower annular open area 56 formed around a downwardly extending center projection 57. The lower part of the projection 57 is formed cylindrical in shape and extends just below the bottom edge of the cylindrical member 54, and has a cylindrical opening 58 to receive the hollow cylindrical output shaft member 26 of the reversing gear drive 106 The annular bottom of the projection 57 has a sealing bead therearound to seal with an annular resilient sealing member 59 located in an annular groove in the surface of the inwardly extending annular flange 19, next to the shaft opening 20 when the sprinkler nozzle housing assembly 108 is fixed to the output shaft member 26. The nozzle housing assembly 108 is fixed to the output shaft member 26 by a pin 60. Other desired fixing means can be used The reduction gear drive 104 has a gear box 292 on the left side as viewed in FIG. 16, and an open area 293 to direct water flow from the water drive turbine wheel 102 to the reversing gear drive 106 where it is connected to the hollow cylindrical output shaft member 226 for delivery to the primary nozzle 251. During assembly, the reversing gear drive 106 and gear box 292 are vacuum-filled with lubricant. The gear box 292 has a cylindrical bore 294 extending downwardly and the lower gear box cover 295 has an upwardly extending annular section 296 of a slightly lesser diameter which allows it to be slid into cylindrical bore 294 to aid in assembly and also generate a close clearance of capillary size. Irregular, spiraled, or otherwise extended, passages may be put onto the outside surface of upwardly extending annular section 296 of the gear box cover 295 to increase the effective length of the vent flow with the cylindrical bore 294. The center area of the upwardly extending annular section 296 may have a felt filter plug 297 and a passage extender 298 cemented, or sonic-welded, into it.

Another feature of the cylindrical bore 294 extending down is that it forces recovery of any water entering to be picked up from the bottom of the gear box 292 inside where water that may have entered to pressure balance the gear box should be.

The expansion and contraction of the lubricant will be accommodated in the extended passages (felt filter plug 297, passage extender 298 and the outside of annular section 296) with any water that reaches the inside of the gear box 292 being the first material to be expelled during expansion.

Having a high-point area 299 of the extended passages with an expanded volume allows any lubricant that might make its way into the high-point area 299 to float and coalesce on top of the more dense water therein. If sufficient volume of lubricant accumulates there, it will be the material that moves in and out of the downward leg of the passage. The gears 221 and 291 are raised above the bottom of the gear box 292 to provide a volume for the vent water to accumulate in and be drawn out of.

Sealing member 59 sees water pressure on its top surface that leaks down around the interface between the output shaft member 26 and the cylindrical opening 58. This water pressure opposes the pressure coming up the shaft of the gear box lubricant around the turning cylindrical output shaft member 226. The gear box lubricant is pressurized to water pressure through passages in felt filter plug 297, passage extender 298 and the outside of annular section 296 (see FIG. 16). This provides the advantage of preventing leakage of lubricant around the output shaft. If any small leakage develops, it will be water seeping out which will tend to keep the rotating seal purged.

The upper part of the downwardly extending center projection 57 has an open area 61 connected to the top of the cylindrical opening 58. An angular projection 62 extends upwardly at a desired angle from center projection 57 and joins solid upper area 55; a cylindrical bore 63 is formed in said angular projection 62 and an aligned opening 64 is formed in the outer surface of cylindrical member 54. A nozzle 51 is inserted through the opening 64 into cylindrical bore 63 where it is fixed in place by gluing. Other fixing means can be used. It can be seen that any water entering open area 61 through hollow cylindrical output shaft member 26 will flow through nozzle 51

Open area 61 has a cylindrical bore 66 extending upwardly in axial alignment with lower cylindrical opening 58 for a short distance, with a smaller axially aligned cylindrical bore 67 extending through the top of the nozzle housing 50. Cylindrical bore 66 and smaller cylindrical bore 67 house a cylindrical member 68 and cylindrical member 69, respectively, along with an annular O-ring seal 70. The top of the cylindrical member 69 has an adjusting slot 71 for setting the desired oscillating angle for the sprinkler. An arrowhead 72 indicates the direction that the nozzle 51 is pointing. A rod 116 extends from the cylindrical member 68 to the reversing gear drive 106 to change the angular movement of the nozzle 51

Figure 6:
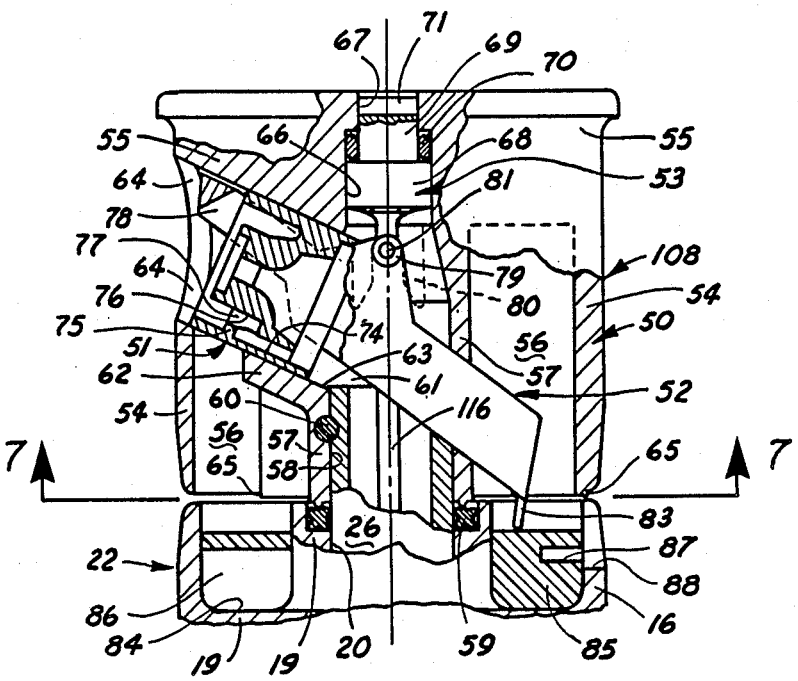
FIG. 6 is a fragmentary longitudinal sectional view of the sprinkler nozzle housing assembly and top of the riser member of FIG. 2 showing the adjustable cam member in its down position with the deflector out of the flow of water exiting from the nozzle.
Figure 7:
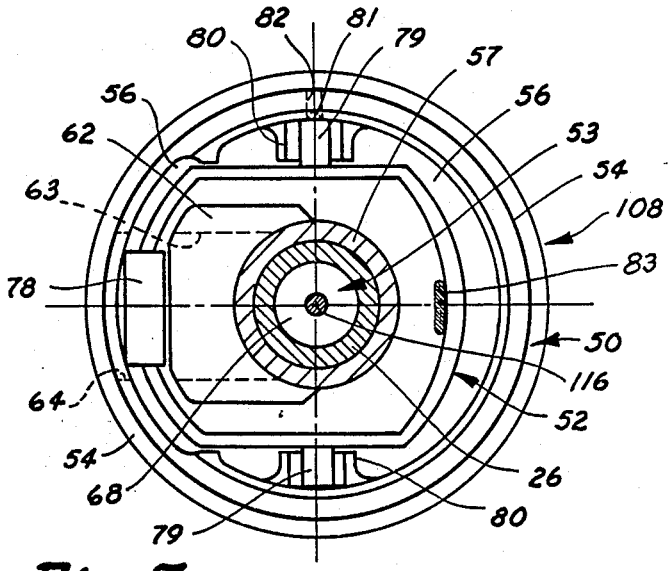
FIG. 7 is a view taken on the line 7—7 of FIG. 6 with the nozzle removed to give an unobstructed view of the nozzle stream deflector device.
Figure 8:
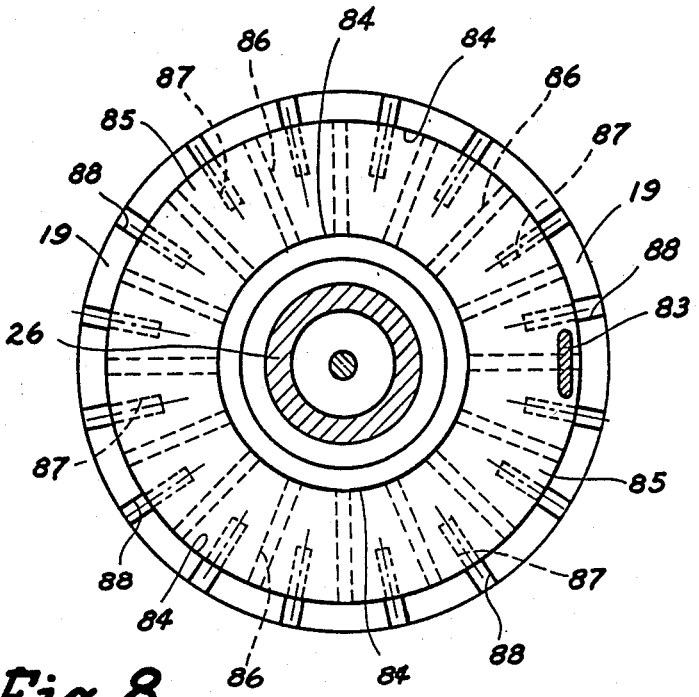
FIG. 8 is a view taken on the line 8—8 of FIG. 2 showing the adjustable cam member of the sprinkler in the annular groove in the top of the riser member.

Nozzle 51 is formed with two flow passages, a center conventional nozzle flow passage 73 and a staggered nozzle flow passage where a passage 74 (see FIG. 6) brings the flow forward to a lip 75 which blocks the flow and forces it to turn and impact on surface 76 before the flow can exit out the staggered passage 77. This configuration imparts high stream turbulence to the water passing through for good short range stream breakup and coverage This is true even with larger passages for lower sensitivity to dirt than for the normal small short range nozzle orifices or slots.

For sprinkler coverage (range) control, a nozzle stream deflector device 52 is located in the lower annular open area 56 of the nozzle housing 50 to move a deflector 78 into or out of the flow of water exiting from nozzle 51 at desired locations during its arcuate movement to obtain a desired programmed pattern around the sprinkler. The nozzle stream deflector device 52 is formed having a forward section including the deflector 78 with a short curved section on each side to fit in the annular open area 56 between the angular projection 62 and the outer wall of the annular open area 56, and a curved rearward section which fits in the annular open area 56. Straight sides connect the cooperating ends of the forward section and rearward section. Pivot shafts 79 extend one from each straight side to provide for pivotal movement of the nozzle stream deflector device 52. The outer wall of the annular open area 56 cooperating with each straight side and pivot shaft 79 has a pivot guide 80 for guiding each pivot shaft 79 to an upper stop limit where a projection 81 in one end of one pivot shaft snaps into a hole 82. This supports the nozzle stream deflector device 52 for assembly. The flow of water through the nozzle 51 acts on the deflector 78 to hold the pivot shafts 79 at their upper limit.

Figure 9:
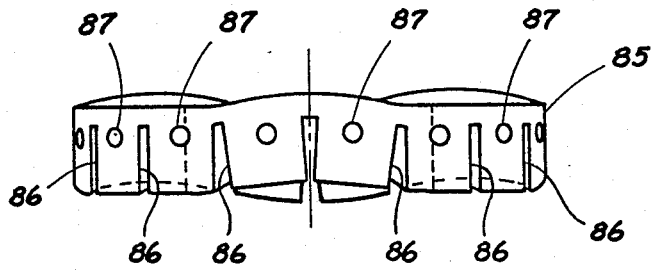
FIG. 9 is a view of an adjustable cam member of the sprinkler removed from the annular groove of the riser and preset in a curved position to achieve a desired coverage pattern around the sprinkler.

The curved rearward section of the nozzle stream deflector device 52 has a cam follower 83 for actuating the deflector to position it, said cam follower 83 extending below the outer edge of the nozzle housing 50. The top of the inwardly extending annular flange 19 has an annular groove 84 therearound with an adjustable cam member 85 therein (see FIG. 9). Adjustable cam member 85 is formed from a ring of resilient material wedged in the annular groove 84. The adjustable cam member 85 has a plurality of slices 86 around the bottom of the adjustable cam member 45 extending to around 75% of the height of the adjustable cam member 85. to permit easy variable height movement of the adjustable cam member 85 in said annular groove 84. To actuate the adjustable cam member 85, holes 87 are positioned around the top of its outer surface, said holes 87 being accessible through slots 88 spaced around the top of the riser member 16. A small diameter pin can be used to raise or lower the adjustable cam member 85 at the side away from the nozzle to achieve whatever peripheral placement is desired to achieve the desired movement of deflector 78 and sprinkler coverage range at each of the slots 88.

The inner edge of the lower end of the cylindrical member 54 of nozzle housing 50 has a downwardly extending bead 65 over the outer edge of the adjustable cam member 85 to limit the upward movement of the cam member 85. The downwardly extending bead 65 is removed below the nozzle to allow room to permit the deflector device 52 to be put in place The nozzle 51 can be pushed further back into passage 63 during assembly to allow putting the deflector 78 into place. It is then moved to the operating position shown in the Figures.

Figure 10:
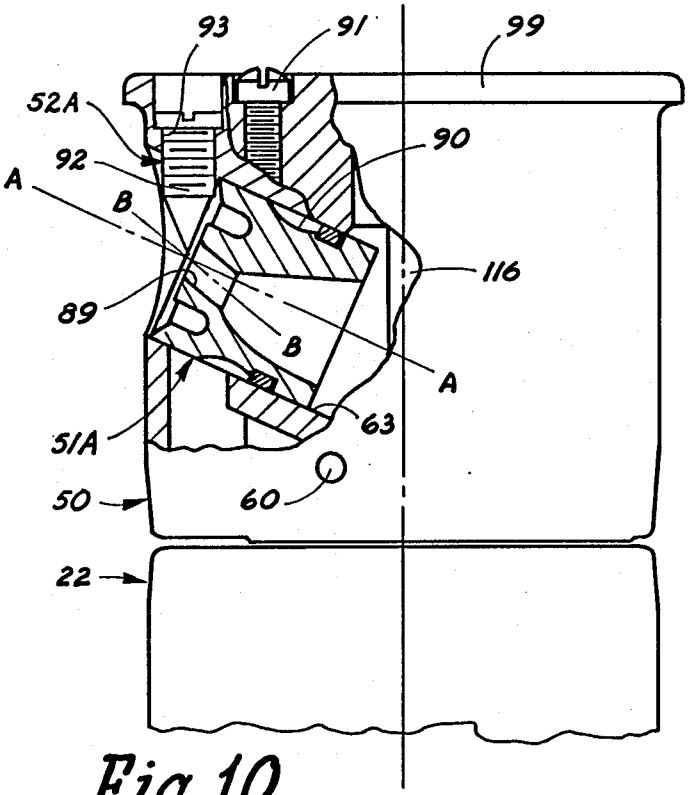
FIG. 10 is a fragmentary longitudinal view of the sprinkler nozzle housing assembly and top of the riser member partly in section showing a modified nozzle and modified manually actuated nozzle stream deflector.
Figure 11:
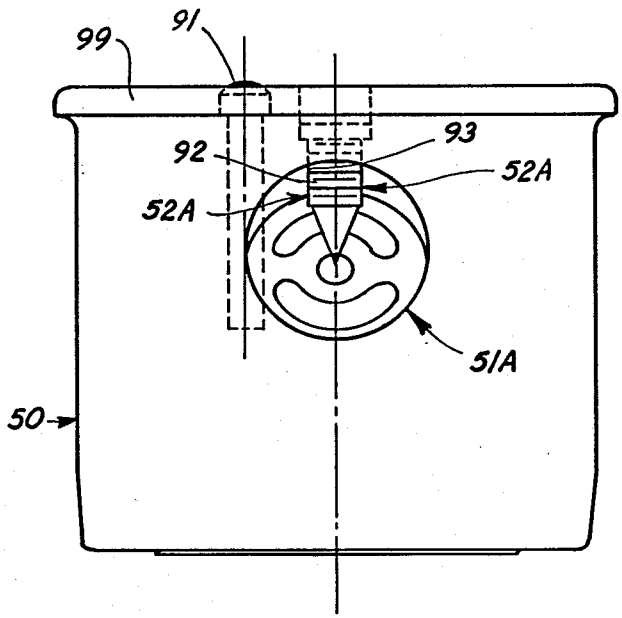
FIG. 11 is a longitudinal view of the sprinkler nozzle housing assembly taken from the left of FIG. 10.
Figure 12:
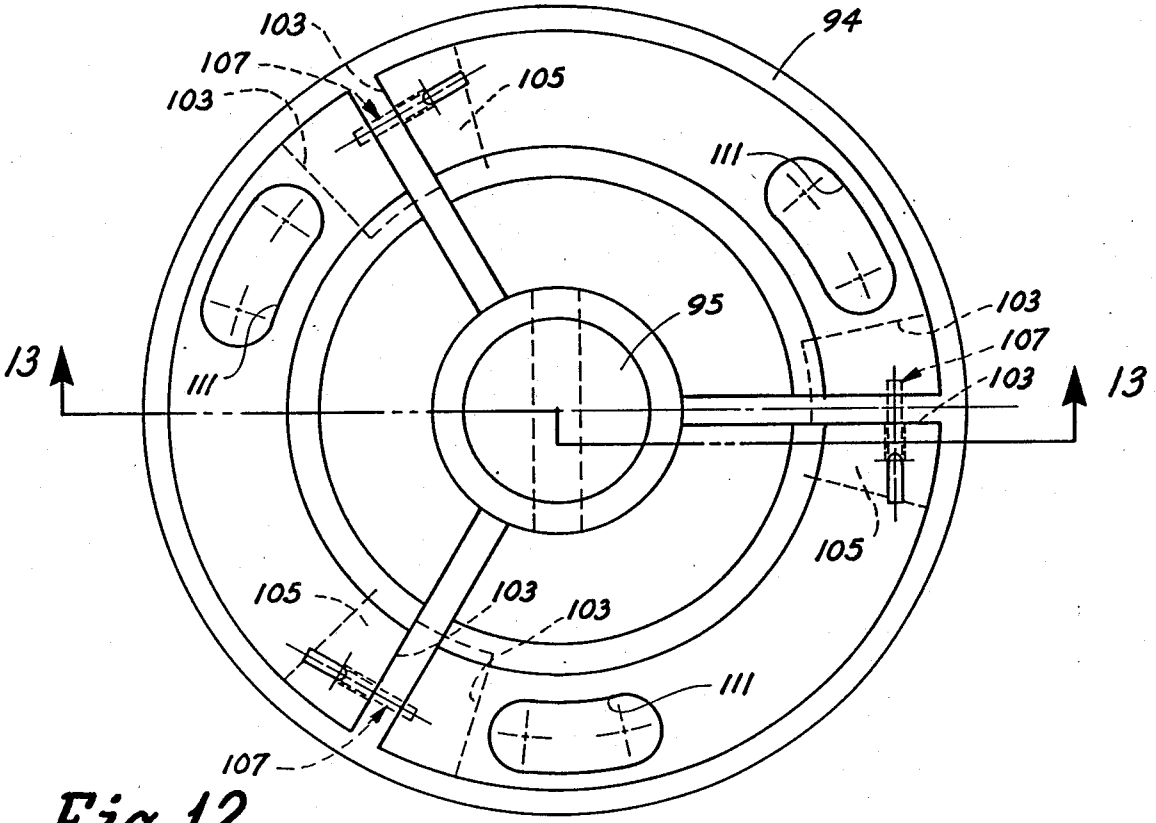
FIG. 12 is a top view of the sprinkler cover and riser assembly removal tool.

A modified sprinkler nozzle housing assembly. shown in FIGS. 10 and 11 sets forth a modified nozzle 51A and a modified manually actuated nozzle stream deflector device 52A. The nozzle 51A is sized to fit the cylindrical bore 63 and has an off-axis outlet orifice 84. Note axis A—A of cylindrical bore 63 and axis B—B of the outlet orifice 89. It can be seen that the stream exiting from the outlet orifice 89 can be angularly changed with respect to the axis A—A of the cylindrical bore 63 to elevate or lower the stream to obtain desired water pattern results. For example, if winds are to be encountered, then a lower angle of flow can be used to decrease the effect of the wind on the desired pattern.

The nozzle 51A has a groove 90 therearound which is positioned to cooperate with a screw 91. The threads of the screw 91 engage the bottom of the groove 90 to cause the nozzle 51A to rotate in cylindrical bore 63, when the screw 91 is rotated, and vary the effective angle of the off-axis outlet orifice 89. The off-axis outlet orifice 89 maintains the center location of the nozzle exit for proper relation to the breakup screw 52A or deflector device 52 as the nozzle 51A rotates.

The modified manually actuated nozzle stream deflector device 52A comprises a threaded member 92 positioned in an internally threaded hole 93 in the edge of the top of the nozzle housing 50 in line with, and intersecting, the forward part of the cylindrical bore 63 in front of the nozzle 51A. The free end of the threaded member 92 of the modified manually actuated nozzle stream deflector device 52A is contoured to vary its effect on the flow exiting the outlet orifice 89 as it is moved up and down in the flow. The contour shown is of a conical form which has a symmetrical effect on the flow therearound Other contours can be used to obtain different sprinkler spray patterns and coverage range.

Figure 13:
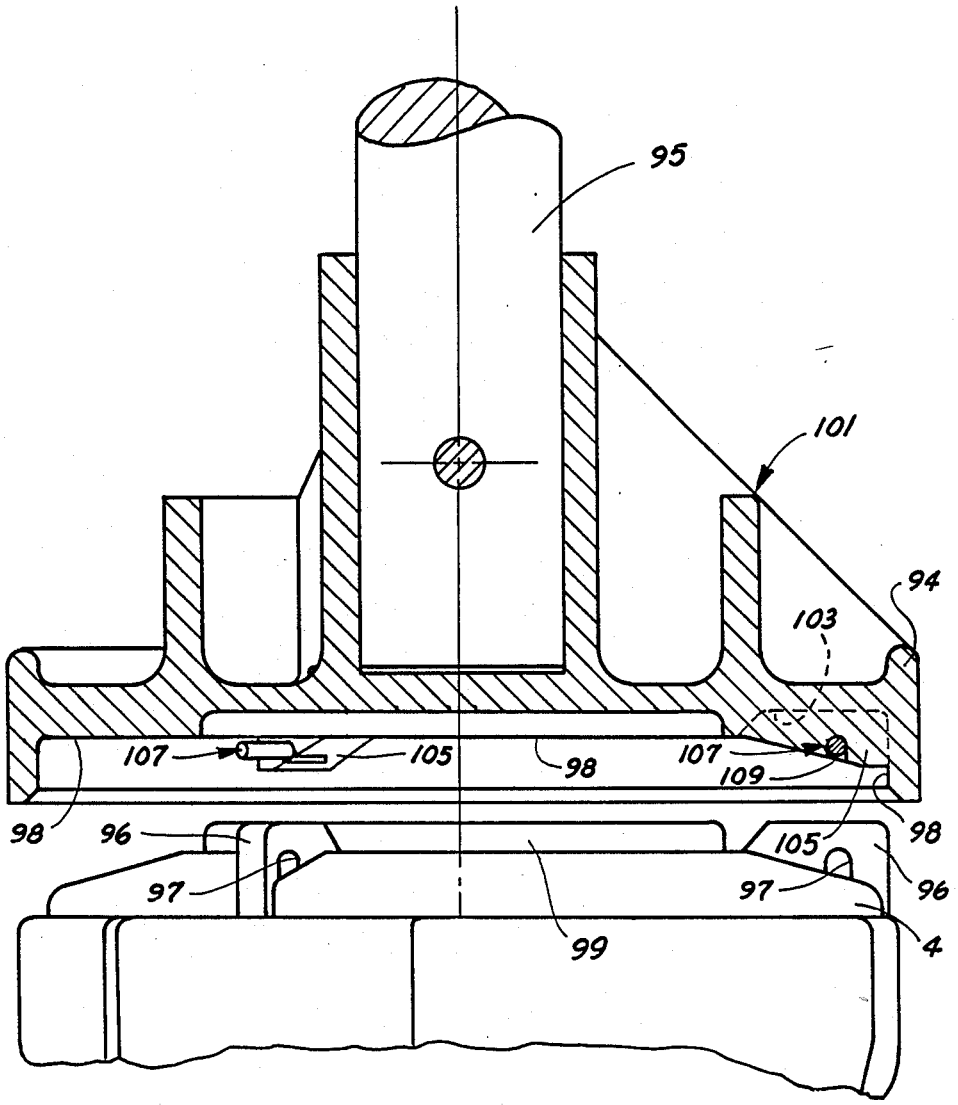
FIG. 13 is a longitudinal cross-sectional view taken on the line 13—13 of FIG. 12 showing the sprinkler cover and riser assembly removal tool and associated sprinkler.
Figure 15:
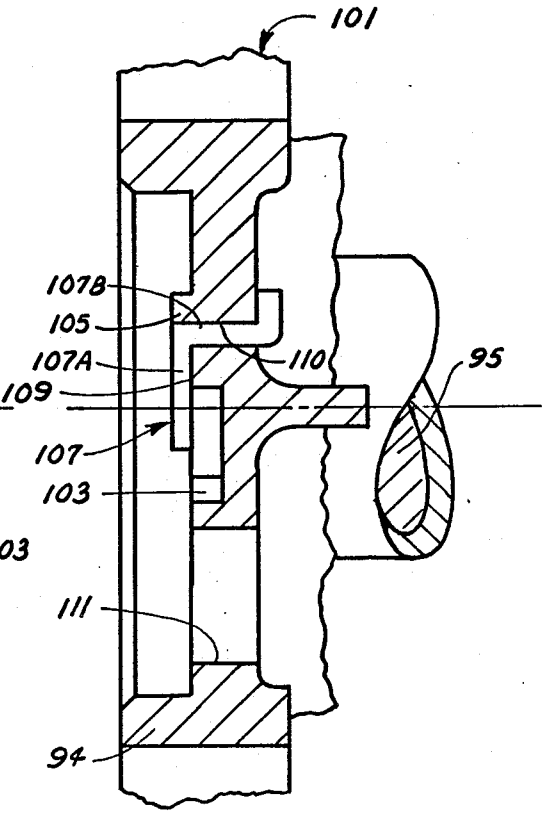
FIG. 15 is a sectional view of the sprinkler cover and riser assembly removal tool taken on the line 15—15 of FIG. 14.
Figure 14:
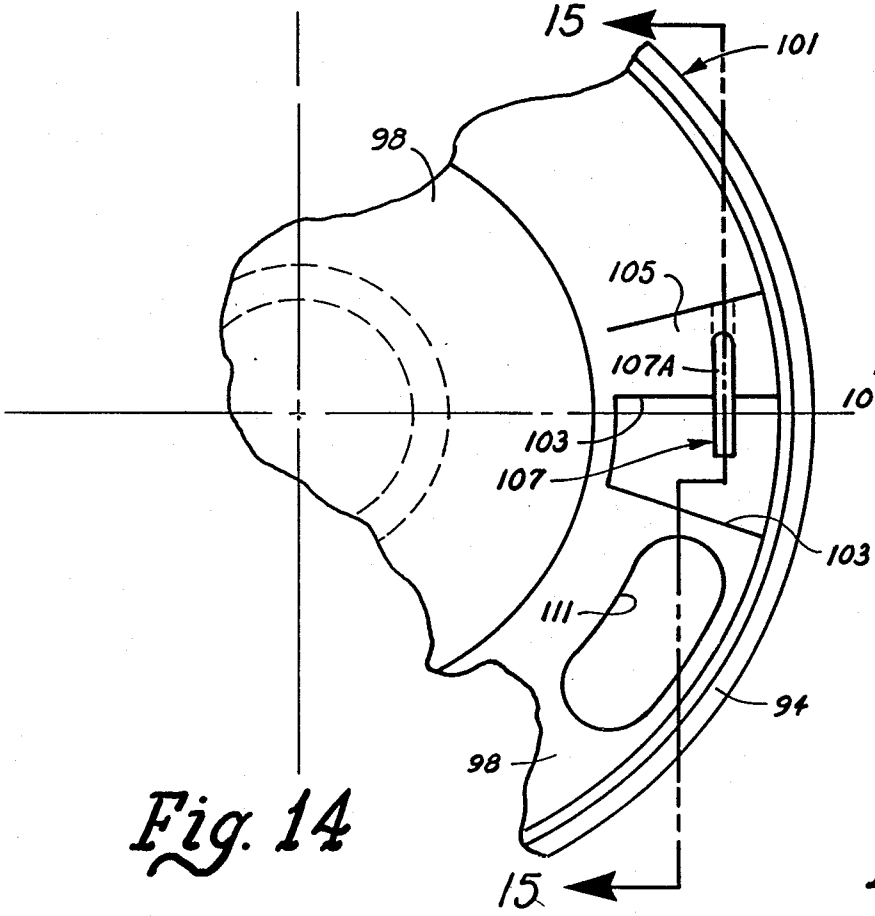
FIG. 14 is a fragmentary bottom view of a portion of the sprinkler cover and riser assembly removal tool showing a cover engaging and lifting rod.

A sprinkler cover and riser assembly removal tool 101 (see FIG. 13) is provided for easy access to the interior of the sprinkler 1. The removal tool 101 comprises a cylindrical cap member 94 with a handle 45, for placing the cap member 44 over the cover 4 of a sprinkler 1. The handle 95 can be made long to use in a standing position. The cover 4 has three equally spaced upstanding ear members 96 which have lifting openings 97 therein for engagement by said removal tool 101.

The cylindrical cap member 94 has a contoured recess 98 for placing over the top of the sprinkler 1 including the top 99 of nozzle housing 50 without encountering interference. The contour of the recess 98 includes three (3) equally spaced individual recesses 103 for receiving the three equally spaced upstanding ear members 96. Each recess 103 allows an angular movement of each upstanding ear member 96 therein, permitting limited rotation between the cover 4 and cylindrical cap member 94.

A projection 105 extends downwardly on the same one side of each of the recesses 103 so that the one side of each recess 103 will extend to the top of the cover 4. A rod 107 extends from each extended side of a recess 103 in a counter-clockwise direction approximately half-way into the recess 103. Each rod 107 is aligned with a cooperating lifting opening 97 of each upstanding ear member 96 when a cylindrical cap member 94 of sprinkler cover and riser assembly removal tool 101 is placed over a sprinkler 1 with each upstanding ear member 106 positioned in the open portion of each cooperating equally spaced individual recess 103 not obstructed by the rod 107.

When the removal tool 101 is turned in a counter-clockwise direction, the rods 107 enter the lifting openings 97 and the extended sides of the recesses 103 engage the upstanding ear members 96. Further turning of the removal tool 101 unlocks the cover 4 from the cylindrical housing 2, which is prevented from rotating by a lock wire 114 or by holding, by placing lugs 14 between lugs 10; the cover 4 can then be lifted off the cylindrical housing 2 with the cover 4 engaging the top 99 of the nozzle housing 50 to also remove the riser assembly 22.

The quick connect-disconnect device is constructed so that the cover 4 fits into the cylindrical housing 2, permitting the cylindrical housing 2 to be gripped when the cover 4 is turned for locking of the lugs 10 and 14 of the quick connect-disconnect device, or for unlocking them. If a lock wire 114 is used between the cylindrical housing 2 and a fixed water pipe 117, gripping will not be necessary.

To replace the cover 4 and riser assembly 22 on the sprinkler 1, a removal tool 101 is placed with its cylindrical cap member 94 over the cover 4 and riser assembly 22 with the rods 107 engaging their cooperating lifting openings 97. The riser assembly 22 is lowered in the cylindrical housing 2 with the lugs 14 of cover 4 passing between the lugs 10 of cylindrical housing 2. The removal tool 101 is then turned in a clockwise direction, removing the rods 107 from the lifting openings 97 with the regular sides of the recesses 103 engaging the upstanding ear members 96 of cover 4. Further turning of the removal tool 101 locks the cover 4 to cylindrical housing 2 by engaging the surfaces A and B of lugs 10 and 14, respectively. The removal tool 101 can then be removed since the rods 107 are disengaged from the lifting openings 97.

One rod 107 is fixed to each projection 105 for extending therefrom. Each rod 107 is formed having a short lifting section 107A and another section 107B bent at 90° thereto. The lifting section 107A fits in a groove 100 in the surface of a projection 105 with the lifting end extending over a recess 103 and with the section 107B extending through a hole 110 in the cylindrical cap member 94. The end of rod section 107B is bent over where it extends out of the hole 110 to fix the rod 107 in place. While one construction has been shown, other means can be used to support rod 107.

Elongated openings 111 are placed in the cylindrical cap member 94 to prevent any interference by a threaded locking pin 112, which might be in a raised position.

Figure 16:
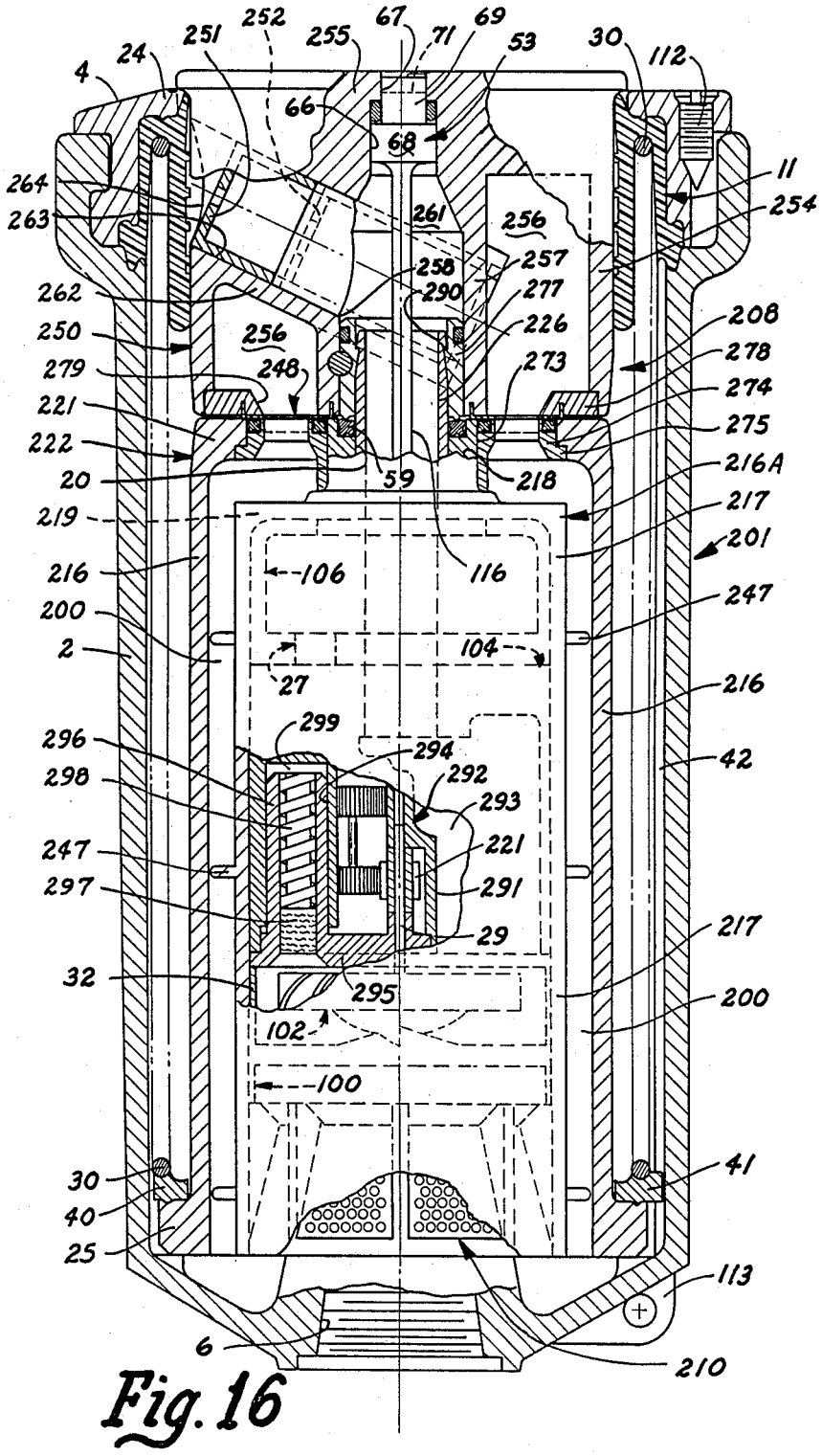
FIG. 16 is a longitudinal sectional view of a modified sprinkler having dual flow in its retracted position taken on the line 16—16 of FIG. 17 with portions of the top of the nozzle housing shown in full; the cover and associated cylindrical housing are shown on the line 16A—16A of FIG. 17 to set forth the cooperation of the cover locking screw and top of the cylindrical housing; details of secondary flow valving are shown; and primary flow and drive mechanism is shown in phantom except for gear box venting.

Referring to FIG. 16 a modified pop-up sprinkler 201 with dual flow is shown having a cylindrical housing 2 with a cover on top thereof, with a resilient cylindrical sealing member 11 fixed therebetween as described for FIG. 3.

The riser member 16 and internal drive components of the pop-up sprinkler 1 become basically the primary flow passage means and drive means 216A of the modified dual-flow pop-up sprinkler 201, which has a housing 217 fixed in a cylindrical riser member 216 and spaced by projections 247 from the inner wall thereof to form a secondary annular flow passage 200 to the top of the riser member 216.

The primary flow passage means and drive means 216A includes the same internal drive components located in the riser member 16 of pop-up sprinkler 1. These parts are:

(1) turbine housing and inlet nozzle means 100;
(2) water drive turbine wheel 102;
(3) reduction gear drive 104, and
(4) reversing gear drive 106.

One additional part, a filter 210, is added below the turbine housing and inlet nozzle means 100. This filter 210 is fixed in place and filters the primary flow entering the bottom of the primary flow passage means and drive means 216A.

The top of the primary flow passage means and drive means 216A is formed having an inwardly extending annular flange 219 on housing 217 connected to an upwardly extending shaft support 218 with a center shaft opening 20. Center shaft opening 20 receives the hollow cylindrical output shaft member 226 of reversing gear drive 106. An annular resilient sealing member 59 is located in an annular groove in the end of the up-wardly extending shaft support 218 next to the hollow cylindrical output shaft member 226

The reversing gear drive 106 is located in the housing 217 with its top against the inner surface of the annular flange 219. The reduction gear drive 104 is located below the reversing gear drive 106 and connected thereto by an output shaft 27. The reduction gear drive 104 is positioned in the housing 217 by a press fit, also positioning the reversing gear drive 106. As before, reference is made to U S. application Ser. No 932,470 for details.

Turbine wheel 102 is located below reduction gear drive 104 and is connected thereto by drive shaft 29 and drive pinion gear 221. The turbine housing and inlet nozzle means 100 is located below reduction gear drive 104 and encloses the turbine wheel 102. The filter 210 is located below the turbine housing and inlet nozzle means 100 and filters the water flow into the primary flow passage means and drive means 216A.

Figure 20:
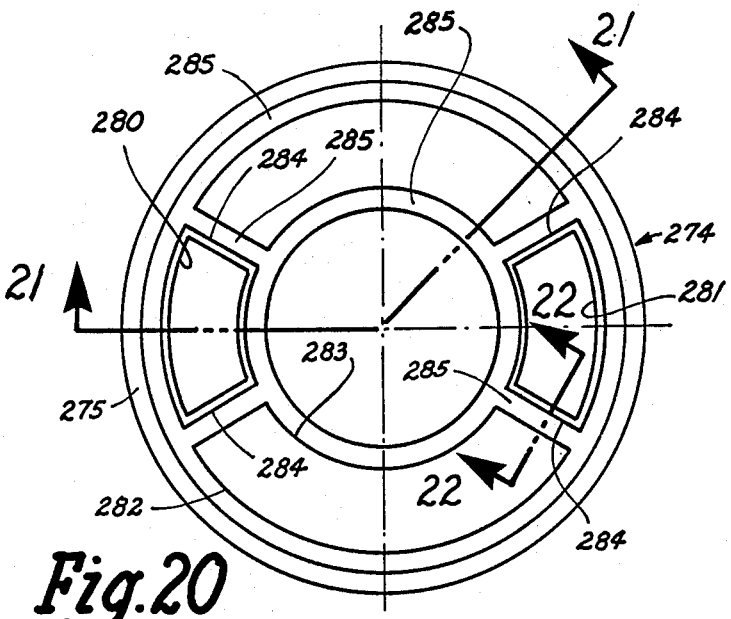
FIG. 20 is a top view of the annular secondary flow inlet insert.
Figure 22:
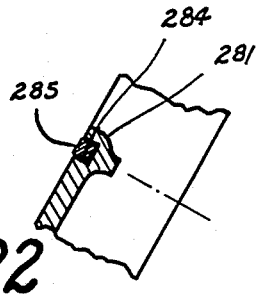
FIG. 22 is a view taken on the line 22—22 of FIG. 20.

The top of cylindrical riser member 216 has an inwardly extending annular flange 221 with a top surface for positioning even with the end of the upwardly extending shaft support 218, forming an annular opening 273 therebetween. Annular opening 273 receives an annular secondary flow inlet insert 274 (see FIGS. 20, 21 and 22).

The lower outer edge of the annular opening 273 has a groove therearound to receive a projecting annular rim 275 on the lower outer edge of annular secondary flow inlet insert 274 which limits its upward position in the annular opening 273 to place its top even with the top of the inwardly extending annular flange 221 of cylindrical riser member 216.

Figure 21:
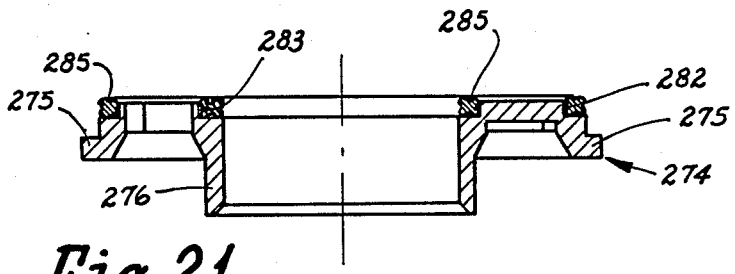
FIG. 21 is a view taken on the line 21—21 of FIG. 20.

The lower inner edge of the annular secondary flow inlet insert 274 is elongated at 276 (see FIG. 21, to engage a raised portion on the top of the inwardly extending annular flange 219 on housing 217. This arrangement permits proper positioning of the primary flow passage means and drive means 216A in the cylindrical riser member 216, placing the end of the upwardly extending shaft support 218 even with the top of the inwardly extending annular flange 221 and the top of the annular secondary flow inlet insert 274.

The cylindrical housing 2 encloses a riser assembly 222 including the cylindrical riser member 216 and a sprinkler nozzle housing assembly 208. The sprinkler nozzle housing assembly 208 is comprised of five (5) main parts. These parts are:

(1) a nozzle housing 250;
(2) a primary nozzle 251;
(3) a secondary nozzle 252;
(4) an adjustable oscillating output control 53; and
(5) a secondary flow control plate 248.

Nozzle housing 250 is formed as a cylindrical member 249 having an outer surface approximately the same diameter as that of riser member 216. The interior of the housing 250 is formed having a solid top and upper area 255 with a lower annular open area 256 formed around a downwardly extending center projection 257. The lower part of the projection 257 is formed cylindrical in shape and extends just below the bottom edge of the cylindrical member 254 and has a cylindrical opening 258 to receive a collar 277 which is connected to the top of the exterior of the hollow cylindrical output shaft member 226. The collar 277 can be snapped on the hollow cylindrical output shaft member 226 by interlocking flange members at 290. A torque limiting lightly splined area is located between the hollow cylindrical output shaft member 226 and collar 277. Should excess external forces be put on the sprinkler nozzle housing assembly 208 to turn it, the internal drive gear mechanism will be protected by rotational slippage at the splined area. The force required for slippage can be controlled by the degree of splining. Other well known fixing means can be used.

The collar 277 has an annular bottom with a sealing bead therearound to seal with the annular resilient sealing member 59 located in the end of shaft support 218 adjacent the hollow cylindrical output shaft member 226. An O-ring seal is located between the collar 277 and cylindrical opening 258. The collar 277 is fixed to the cylindrical part of projection 257 by a pin 60.

The inner lower end of the cylindrical member 254 has an inwardly extending annular flange 278 with a lower surface even with the lower end of the lower part of the projection 257 which is cylindrical in shape. An annular opening 279 is formed between the cylindrical lower part of the projection 257 and the inner end of the inwardly extending annular flange 278. It can be seen that the annular opening 279 is located over the top of the fixed annular secondary flow inlet insert 274. The annular top of the annular secondary flow inlet insert 274 is formed having two open arcuate inlet ports 280 and 281 while the remainder is closed. An annular groove 282 (see FIG. 22) is formed around the upper outer edge and an annular groove 283 is formed around the upper inner edge of annular secondary flow inlet insert 274. Radial grooves 284 are formed connecting the annular grooves 282 and 283 on each end of the two open arcuate inlet ports 280 and 281. These two open arcuate inlet ports 280 and 281 form the secondary flow inlets to the sprinkler nozzle housing assembly 208. A composite seal member 285 extends in all of the annular grooves 282, 283 and radial grooves 284. The annular portions and radial portions of the composite seal member 285 extend above the top of the annular secondary flow inlet insert 274 for sealing engagement with a rotatable secondary valving flow control plate 248.

Secondary flow control plate 248 is positioned over the annular opening 279. The inner circular edge of the secondary flow control plate 248 is bent to form a short cylindrical flange 286 and the outer circular edge of the secondary flow control plate 248 is also bent to form a short cylindrical flange 287. The short cylindrical flange 286 is fixed in a cylindrical slot in the lower cylindrical end of the downwardly extending center projection 257 and the short cylindrical flange 287 is fixed in a cylindrical slot in the inner end of inwardly extending annular flange 278. Other fixing means can be used.

The secondary valving flow control plate 248 has arcuate valving openings 288 and 289 placed therein to direct selected secondary flow from the two arcuate inlet ports 280 and 281 to the lower annular open area 256 where it can enter secondary nozzle 252. The composite seal member 285 seals the flow between the two arcuate inlet ports 280 and 281 of the annular secondary flow inlet insert 274 and the arcuate valving openings 288 and 289 of the secondary flow control plate 248. The arcuate inlet ports 280 and 281 can be preselected (i.e., varied in size, number, shape, etc.) to cooperate with preselected (i.e., varied in size, number, shape, etc arcuate valving openings 288 and 289 to obtain a desired flow pattern through secondary nozzle 252 to add to the circular pattern attained by the primary nozzle 251. An example will be hereinafter disclosed.

The upper part of the downwardly extending center projection 257 has an open area 261 connected to the top of the cylindrical opening 258 An angular projection 262 extends upwardly from center projection 257 and joins solid upper area 255; a cylindrical bore 263 is formed in said angular projection 262 and an aligned opening 264 is formed in the outer surface of cylindrical member 254. A nozzle 251 is inserted through the opening 264 into cylindrical bore 263 where it is fixed in place by gluing. Other fixing means can be used. Primary water flow entering open area 261 through hollow cylindrical output shaft member 226 will flow through primary nozzle 251.

Open area 261 has a cylindrical bore 66 extending upwardly in axial alignment with lower cylindrical opening 258 for a short distance, with a smaller axially aligned cylindrical bore 67 extending through the top of the nozzle housing 250. Cylindrical bore 66 and smaller cylindrical bore 67 house a cylindrical member 68 and cylindrical member 69, respectively, along with an annular O-ring seal 70. The top of the cylindrical member 69 has an adjusting slot 71 for setting the desired oscillating angle for th sprinkler. An arrowhead 72 indicates the direction that the nozzles 251 and 252 are pointing. A rod 116 extends from the cylindrical member 68 to the reversing gear drive 106 to change the angular movement of the nozzles 251 and 252.

Figure 17:
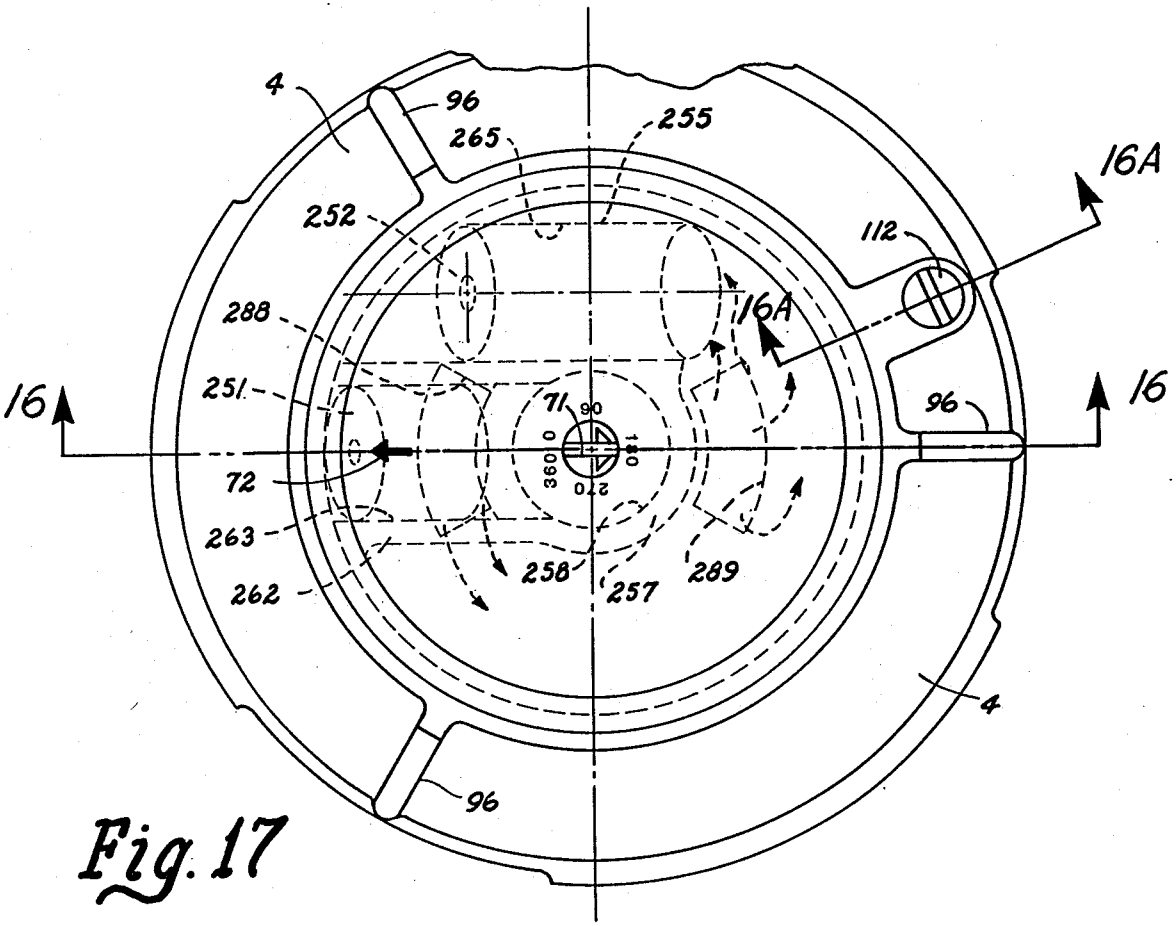
FIG. 17 is a top view of the modified sprinkler of FIG. 16 showing the cover and axially movable center nozzle housing assembly with the primary and secondary nozzles shown by dotted lines in their cylindrical bores in the solid top and upper area of the nozzle housing along with the openings in the secondary flow control plate.
Figure 18:
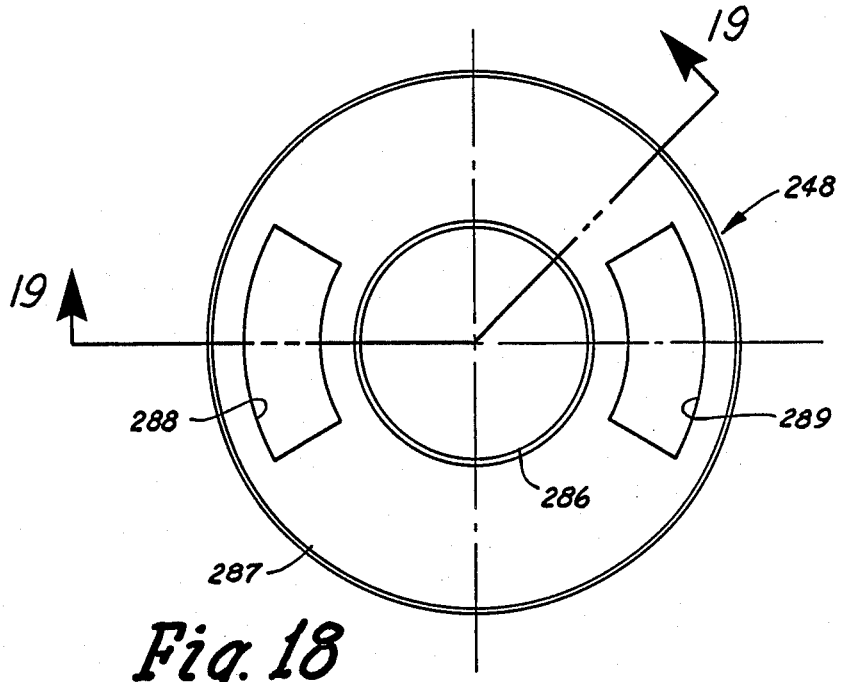
FIG. 18 is a top view of a secondary flow control plate.
Figure 19:
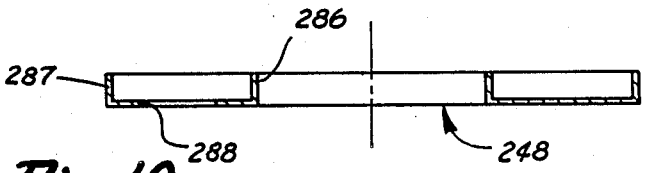
FIG. 19 is a view taken on the line 19—19 of FIG. 18.

The solid upper area 255 has a cylindrical bore 265 formed therein to the side (see FIG. 17) of the cylindrical bore 263 and has an aligned opening in the outer surface of cylindrical member 254 where the cylindrical bore 265 exits. A nozzle 252 is inserted through the aligned opening into cylindrical bore 265 where it is fixed in place by gluing. Other means can be used. Secondary water flow entering the lower annular open area 256 through openings 288 and 289 will flow through secondary nozzle 252

Figure 23:
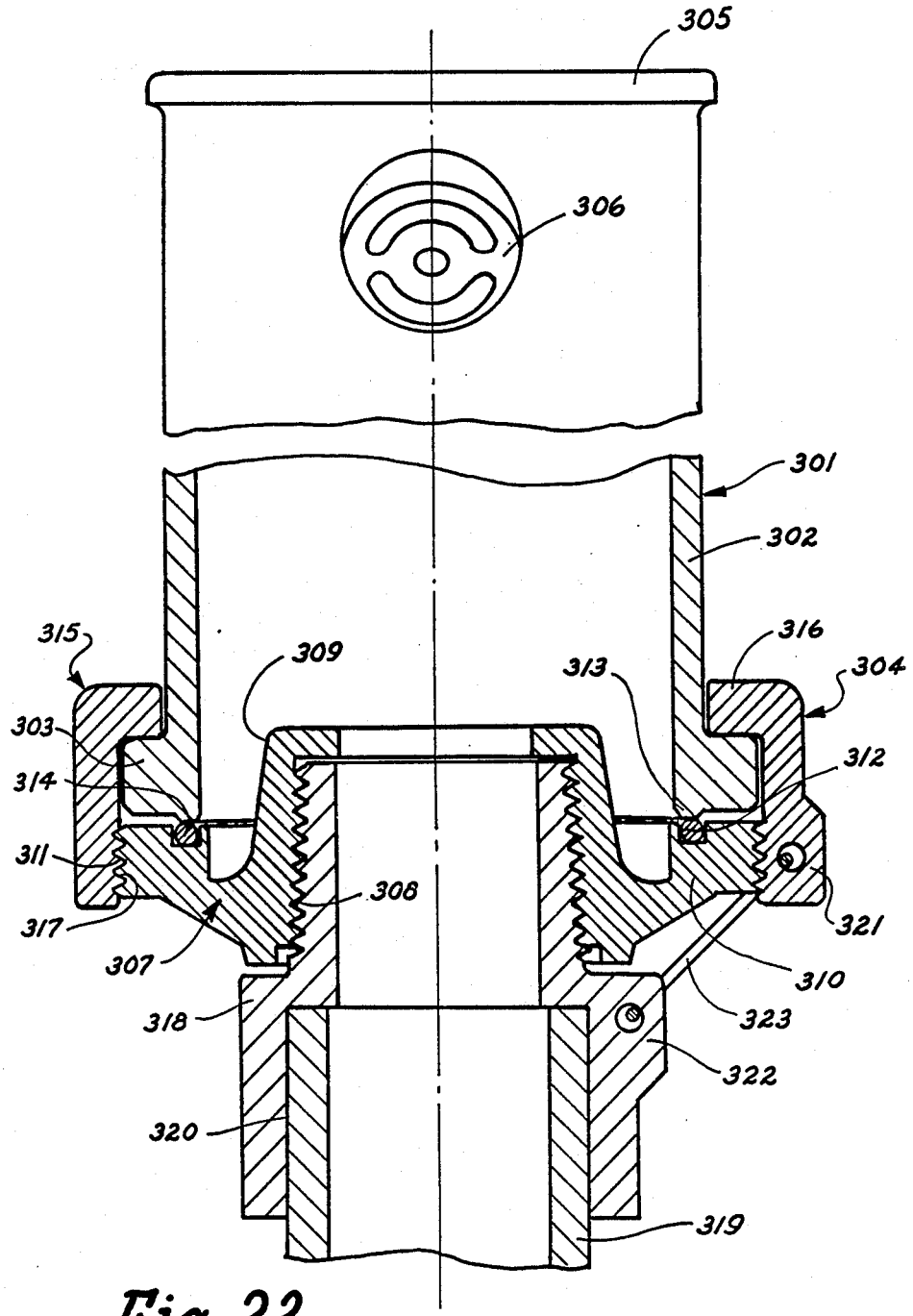
FIG. 23 is a fragmentary view partially in section of a non-pop-up sprinkler with anti-vandal locking wire and adjustable rotatable housing.

A non-pop-up sprinkler 301 having a fixed length is shown in FIG. 23. The sprinkler 301 is formed having a hollow cylindrical riser member 302 with an annular outwardly extending flange 303 at the bottom thereof.

Hollow cylindrical member 302 has a top 305 and a nozzle 306 positioned on the side near the top. A housing 304 encloses the annular outwardly extending flange 303.

Housing 304 has a bottom member 307 with an internally threaded inlet 308 in a short hollow cylindrical member 309. The internally threaded inlet 308 is for connection with a water inlet pipe connection. A threaded connector 318 is shown threaded to the housing 304 with an inlet pipe 319 fixed thereto at 320. An annular flange 310 extends outwardly from the short hollow cylindrical member 309 to a point just outwardly from the outer periphery of the flange 303. The annular flange 310 has external threads 311 around its outer periphery and has an annular groove 312 facing an annular bead 313 extending downwardly from the bottom of the flange 303. Annular bead 313 is sized to enter the annular groove 312. A resilient O-ring 314 is located in the annular groove 312 and extends out of the groove 312 to seal with the mating annular bead 313.

Housing 304 has an annular top member 315 having an internally extending annular flange 316 at the top thereof to engage the top of the annular outwardly extending flange 303 and internal threads 317 at the bottom thereof to mate with the external threads 311.

In operation, it can be seen that the tightening movement of the top member 315 will force the annular bead 313 against the resilient O-ring 314 to provide a sealing action. This connection also provides for the turning of the cylindrical riser member 302 in relation to the housing 304.

A locking lug 321 having an opening is provided on the bottom of the annular top member 315 externally of the threads 317 and locking lug 322 is provided on the outer surface of the threaded connector 318 so that the sprinkler 301 can be lock wired by a wire 323 to the ground water piping system. While the locking lug 322 is shown on the connector 318, the wire 323 can be connected to another fixed part, such as the inlet pipe 319, which will keep the housing 304 from turning. This lock wire connection provides (1) for easy turning of the riser member 302 for directionally positioning the nozzle 306; and (2) a deterrent to unauthorized removal, including theft.

Figure 25:
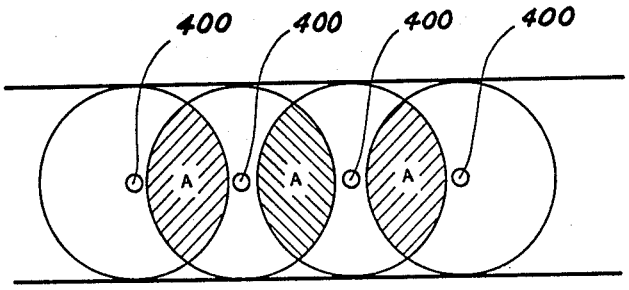
FIG. 25 is a conventional in-line sprinkler pattern layout with single flow sprinklers having centers at 55% of the sprinkler's coverage diameter.

FIG. 25 shows an installation of conventional sprinklers 400 in a line for a relatively narrow width-to-length installation, such as along roadways and islands between houses or highways. A sprinkler spacing used is 55% of the sprinkler diameter in order to get adequate coverage along the outside. This results in double-watering of the shaded areas A and an increased total water usage of 33% (133% of what would be required for uniform precipitation coverage). Since most of the available sprinklers on the market today have uniform distance patterns around the sprinkler, the overlapping coverage is tolerated.

Figure 26:
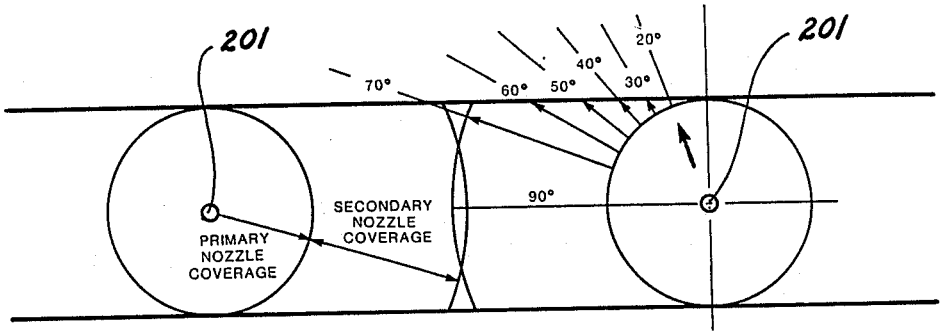
FIG. 26 is an in-line sprinkler pattern layout using programmed dual-flow sprinklers as shown in FIG. 16, each having a secondary flow control as shown in FIG. 24.

FIG. 26 shows an installation of the disclosed dual-flow, primary flow and secondary flow, sprinklers 201 see FIG. 16) having programmable flow control of the secondary nozzle 252 by the use of the secondary flow control plate 248 and annular secondary flow inlet insert 274. It can be seen that the number of sprinklers needed is less using the same water source. If greater coverage overlap is desired, the sprinklers 201 can be moved closer together. In this installation, the dual-flow sprinkler 201 with secondary flow control is able to take advantage of the available maximum range by turning on and off the secondary nozzle 252 to provide a programmed coverage range to cover the extended length area beyond the area covered by the primary nozzle 251. Since the range covered by the primary nozzle 251 is less and it flows all of the time the sprinkler is running, it is used to provide the drive power of the sprinkler with a pressure drop across the water drive turbine wheel 102. The pressure of the secondary nozzle flow is not affected by pressure losses through the turbine wheel 102.

Figure 24:
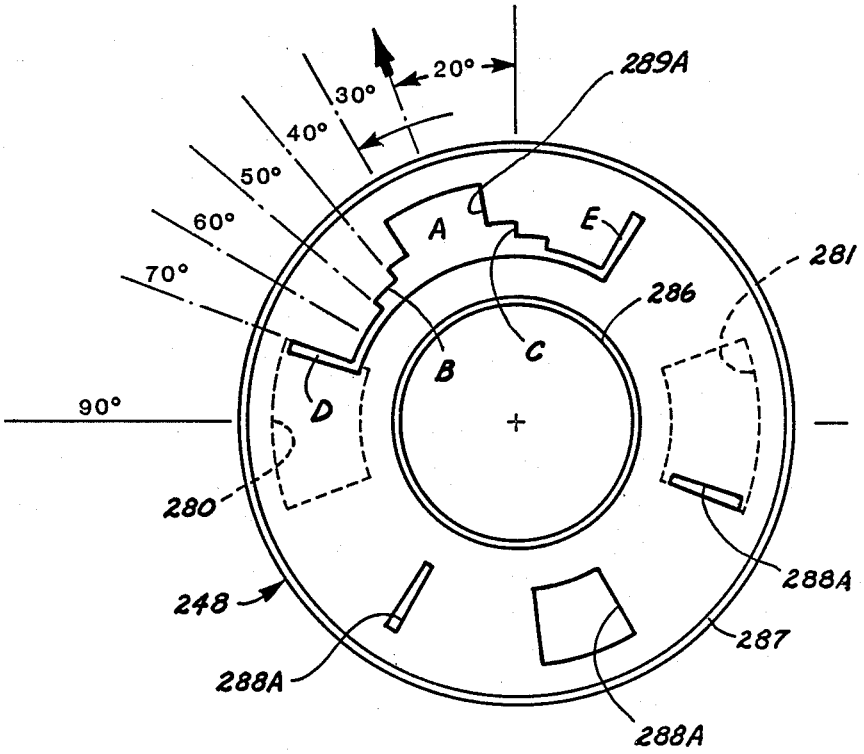
FIG. 24 is a top view of a secondary flow control plate having specific arcuate valving openings to cooperate with specific arcuate inlet ports (shown by the dashed lines) to provide extended coverage in two directions as shown in FIG. 26.

In FIG. 24, the arcuate valving opening 289A is contoured to obtain a programmed pattern as shown in FIG. 26 through secondary nozzle 252 to add to the circular pattern attained by the primary nozzle 251. Arcuate valving openings 288A are provided to obtain greater flow at selected angular positions in relation to arcuate valving opening 289A.

The arcuate inlet ports 280 and 281 are selected having an arc to permit the water flow to reach the proper width of the strip to be covered at a maximum range through a selected center arcuate valving opening section A to add to the circular pattern attained by the primary nozzle 251; to provide the proper flow and range at various angular positions to complete the coverage on either side of the area covered by the arcuate valving opening section A, the arcuate valving opening is reduced on either side of section A by sections B and C each having three steps; the three steps of section B cause an increase in flow up to section A and the three steps of section C cause a decrease in flow after section A; an enlarged opening section D is provided at the end of section B to start the secondary flow rapidly and an enlarged opening section E is provided at the end of section C to maintain proper flow to the end. Valving opening 289A can be continuously contoured instead of the stepped fashion that is shown, to obtain similar results.

It is to be understood that changes and modifications may be made to the disclosed invention without departing from the spirit and scope of the invention as defined in the claims.

I claim:

1. A sprinkler, said sprinkler having a rotatable nozzle housing, a nozzle in said housing to direct a flow therefrom, means for directing a flow of water to said nozzle, a deflector means within said nozzle housing for moving in or out of the flow directed from said nozzle during operation, a riser member, said rotatable nozzle housing being mounted for rotation on said riser member, cam means on said riser member for camming said deflector means into the flow directed from said nozzle during operation, said riser member having a groove means thereon, said cam means being located in said groove means, said cam means being resilient, means for changing the position of said cam means in said groove means to change the movement of said deflector means as said nozzle housing rotates, said groove being annular, said cam means being annular, and said cam means being formed with radial cuts to make it easier to change its position.

2. A sprinkler, said sprinkler having a rotatable nozzle housing, a nozzle in said housing to direct a flow therefrom, means for directing a flow of water to said nozzle, a deflector means within said nozzle housing for moving in or out of the flow directed from said nozzle during operation, a riser member, said rotatable nozzle housing being mounted for rotation on said riser member, cam means on said riser member for camming said deflector means into the flow directed from said nozzle during operation, said riser member having a groove means thereon, said cam means being located in said groove means, said cam means being resilient, means for changing the position of said cam means in said groove means to change the movement of said deflector means as said nozzle housing rotates, said cam means being frictionally held in said groove means, said cam means having an inner and outer surface, said means for changing the position of said cam means including radial openings into the outer surface of said cam means, elongated openings around said riser member extending to said groove, each elongated opening being aligned with a radial opening in said cam means for reaching each radial opening to move it up or down to position the cam means.

3. A sprinkler, said sprinkler having a rotatable nozzle housing, a nozzle fixed to said housing to direct a flow therefrom, means for directing a flow of water to said nozzle, a deflector means within said nozzle housing for moving in or out of the flow directed from said nozzle during operation, a riser member, said rotatable nozzle housing being mounted for rotation on said riser member, cam means on said riser member for camming said deflector means into the flow directed from said nozzle during operation, said nozzle housing having a top and bottom, an annular opening formed in said nozzle housing extending upwardly from the bottom of said nozzle housing, a center opening formed in said nozzle housing extending upwardly from the bottom of said nozzle housing, said nozzle extending between said center opening and said annular opening, an exit opening in said nozzle housing aligned with said nozzle, said means for directing a flow of water to said nozzle directing a flow of water into said center opening then to said nozzle, said deflector means being located in said annular opening and extending therearound, pivot means pivoting said deflector means to the nozzle housing forming the annular opening, said deflector means having a deflector for moving into or out of the flow directed from said nozzle during sprinkler operation between said nozzle and exit opening, said deflector means having a cam follower to position said deflector into the flow, said cam follower being actuated by said cam means.

4. A combination as set forth in claim 3 wherein said deflector means extending around said annular opening comprises a forward section, side sections, and a rearward section, said forward section of said deflector means having said deflector, said rearward section of said deflector means having said cam follower, said pivot means extending between said side sections and said nozzle housing.

5. A sprinkler having a rotatable nozzle housing, a cylindrical bore therein, a cylindrical nozzle positioned in said cylindrical bore, said cylindrical nozzle having an axis of rotation, said cylindrical nozzle having a nozzle outlet passage therein, said nozzle outlet passage having an axis at an angle to the axis of rotation of said cylindrical nozzle, the exit of said nozzle outlet passage being located at the center of said cylindrical nozzle so that as said cylindrical nozzle turns said exit of said nozzle outlet passage remains centered, means for rotating said cylindrical nozzle to change the position of the axis of said nozzle outlet passage around the axis of rotation of said cylindrical nozzle, means for directing a flow of water to said cylindrical nozzle, a deflector means within said nozzle housing for moving in or out of the flow of water directed from the centered exit of said nozzle outlet passage, the relationship of the deflector means and centered exit remaining the same as the position of the axis of the nozzle outlet passage is being changed.

6. A sprinkler as set forth in claim 5 including a riser member, said nozzle housing being mounted for rotation on said riser member, cam means on said riser member for camming said deflector means into the flow directed from the centered exit of said nozzle outlet passage.

7. A combination as set forth in claim 5 wherein said means for rotating said cylindrical nozzle includes an actuating screw mounted in said nozzle housing and extending to the top thereof for actuation, means connecting said actuating screw to said cylindrical nozzle, rotation of said actuating screw rotating said cylindrical nozzle to change the position of the axis of said nozzle outlet passage.

* * * * *